US009189910B2

(12) United States Patent
Otsuka et al.

(10) Patent No.: US 9,189,910 B2
(45) Date of Patent: Nov. 17, 2015

(54) BANKNOTE PROCESSING DEVICE AND MOUNTING TABLE THEREFOR

(75) Inventors: Yoshiyuki Otsuka, Hyogo (JP); Shinichi Nonaka, Hyogo (JP); Tsuyoshi Hodatsu, Hyogo (JP)

(73) Assignee: GLORY LTD., Himeji-Shi, Hyogo (JP)

( * ) Notice: Subject to any disclaimer, the term of this patent is extended or adjusted under 35 U.S.C. 154(b) by 314 days.

(21) Appl. No.: 13/325,496

(22) Filed: Dec. 14, 2011

(65) Prior Publication Data

US 2012/0156000 A1 Jun. 21, 2012

(30) Foreign Application Priority Data

Dec. 17, 2010 (JP) ..... 2010-282418

(51) Int. Cl.

| | |
|---|---|
| ***G07D 11/00*** | (2006.01) |
| ***B65H 31/00*** | (2006.01) |
| *B65B 27/08* | (2006.01) |

(52) U.S. Cl.

CPC ..... *G07D 11/0084* (2013.01); *B65H 31/00* (2013.01); *B65B 27/08* (2013.01); *B65H 2402/44* (2013.01); *B65H 2407/31* (2013.01); *B65H 2701/1912* (2013.01)

(58) Field of Classification Search

USPC ..... 55/385.1, 385.2, 417, 467, DIG. 18; 454/56, 62, 63, 67, 57, 66, 49; 414/788.1, 790.9

See application file for complete search history.

(56) References Cited

U.S. PATENT DOCUMENTS

| | | | | |
|---|---|---|---|---|
| 4,201,256 | A * | 5/1980 | Truhan | 144/252.2 |
| 6,444,002 | B1 * | 9/2002 | Mai | 55/385.1 |
| 6,811,587 | B1 * | 11/2004 | Lorey et al. | 55/385.2 |
| 8,430,940 | B2 * | 4/2013 | Nguyen | 55/385.2 |
| 8,561,512 | B2 * | 10/2013 | Loveless et al. | 83/168 |
| 2010/0006482 | A1 | 1/2010 | Koga et al. | |
| 2010/0218467 | A1 * | 9/2010 | Witter | 55/337 |

FOREIGN PATENT DOCUMENTS

| | | | | |
|---|---|---|---|---|
| CN | 2140702 | Y | 8/1993 | |
| CN | 2314725 | Y | 4/1999 | |
| CN | 102100446 | A * | 6/2011 | 55/385.2 |
| CN | 102243776 | A * | 11/2011 | 55/385.2 |
| CN | 202112582 | U * | 1/2012 | 55/385.2 |
| CN | 202120341 | U * | 1/2012 | 55/385.2 |
| JP | 4-77 | | 1/1992 | |
| JP | 2600100 | | 7/1999 | |
| JP | 2003-50028 | A * | 2/2003 | 55/385.2 |

OTHER PUBLICATIONS

Chinese Office Action (Application No. 201110412945.0) (10 pages—dated Dec. 3, 2013).

* cited by examiner

*Primary Examiner* — Duane Smith
*Assistant Examiner* — Minh-Chau Pham
(74) *Attorney, Agent, or Firm* — Renner, Kenner, Greive, Bobak, Taylor & Weber

(57) ABSTRACT

A banknote processing device is mounted on a mounting table. The banknote processing device includes a stacking unit having an opening for removing banknotes. A dust collection vent is arranged in front of the opening of the stacking unit on the mounting table. A suction fan sucks dust dispersing from the opening of the stacking unit into a dust collection vent. A filter captures the dust from air that is sucked in. A duct expels a dust-free air from an exhaust vent provided in an exhaust passage formed around the suction fan. In another configuration, the dust collection vent is provided inside the stacking unit, and the dust generated inside the stacking unit is sucked in by the suction fan.

19 Claims, 5 Drawing Sheets

2
11
12
13
13A
14
17
17A
17B
17C
18A(18)
18C(18)
19
30E
30F
30G
30H
31E
31F
31G
31H
32E
32F
32G
32H
33
34E
34F
34G
34H
10

2
11
12
13
13A
14
17
17A
17B
17C
18A(18)
18C(18)
19
16A
16B
16C
16D
30A
30B
30C
30D
31
32
33
34
10

BANKNOTE PROCESSING DEVICE AND MOUNTING TABLE THEREFOR

BACKGROUND OF THE INVENTION

1. Field of the Invention

The present invention relates to a banknote processing device and a mounting table therefor capable of sucking up paper dust and dirt generated in the course of banknote processing.

2. Description of the Related Art

Techniques for preventing dispersion of paper dust, dust, etc. (hereinafter "dust") generated in the course of processing large quantities of banknotes by using banknote processing devices are known in the art. Dust comes off the banknotes when the banknotes are transported and stacked at a high speed, and this dust gets dispersed around due to an air flow brought about by the transportation and stacking of the banknotes.

A banknote processing device having a stacking unit that has an opening is particularly disadvantageous in that a large amount of dust coming off the banknotes is directed at a user. The banknote processing device disclosed in Japanese Utility Model Registration No. 2600100 provides a solution to this problem by way of arranging a suction device on a lateral side of the device main unit.

Meanwhile, the banknote processing device disclosed in Japanese Utility Model Application Publication No. H4-77 includes a suction device below a banknote transport path for sucking in the dust. The banknote processing device further includes a blocking shield above an open stacking unit to prevent dispersion of the dust.

However, in the conventional technologies described above where the suction device is provided on the lateral side of the stacking unit or below the transport path, there is a disadvantage that not all the dust dispersing from the stacking unit gets sucked in. If a larger suction device is used to get a better suction effect, there will be an undesirable increase in the overall size and weight of the banknote processing device. A large suction device is particularly unsuitable for a small-sized banknote processing device meant for mounting on a table or a counter. Furthermore, even if the blocking shield is provided between the stacking unit and the user, the dust that is floating around in the air cannot be fully blocked. This results in the dust that has dispersed in the air settling eventually on an underside of the stacking unit and on the mounting table, which is undesirable.

SUMMARY OF THE INVENTION

The present invention is made in view of the above discussion, and it is an object of the present invention to provide a banknote processing device and a mounting table therefor capable of effectively collecting the dust generated in the course of banknote processing.

According to an aspect of the present invention, a mounting table is for mounting a banknote processing device that includes a stacking unit with an opening. The mounting table includes a dust collection vent that is arranged in front of the opening of the stacking unit and that collects dust coming out of the opening of the stacking unit.

According to another aspect of the present invention, a banknote processing device that counts banknotes includes a stacking unit. The stacking unit includes an opening to enable removal of the banknotes stacked inside the stacking unit; and a dust collection vent for collecting dust inside the stacking unit.

According to still another aspect of the present invention, a banknote processing device that counts banknotes includes a stacking unit that has an opening for enabling removal of the banknotes stacked therein; and a table that extends in front of the opening of the stacking unit. The table includes a dust collection vent to collect dust dispersing from the stacking unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a banknote processing device and a mounting table therefor according to the present invention are explained in detail below with reference to the accompanying drawings.

A banknote processing device according to an embodiment has a stacking unit with at least a portion thereof being open to enable banknotes stacked inside to be removed through the opening. Moreover, a dust collection vent that sucks the dust from inside the stacking unit is arranged inside the stacking unit. A mounting table for the banknote processing device according to an embodiment includes a dust collection mechanism, which is similar to the one described above, arranged near the opening of the stacking unit outside thereof that sucks in the dust dispersing from the opening of the stacking unit. The embodiments of the present invention can be generally applied to open-stacker type banknote processing devices regardless of the size of the banknote processing device, the number of the stacking units, and the configuration and function of the banknote processing device. However, given below is a detailed explanation of the banknote processing device that includes a plurality of the open stacking units (hereinafter, simply "stackers").

First Embodiment

Figure 1:
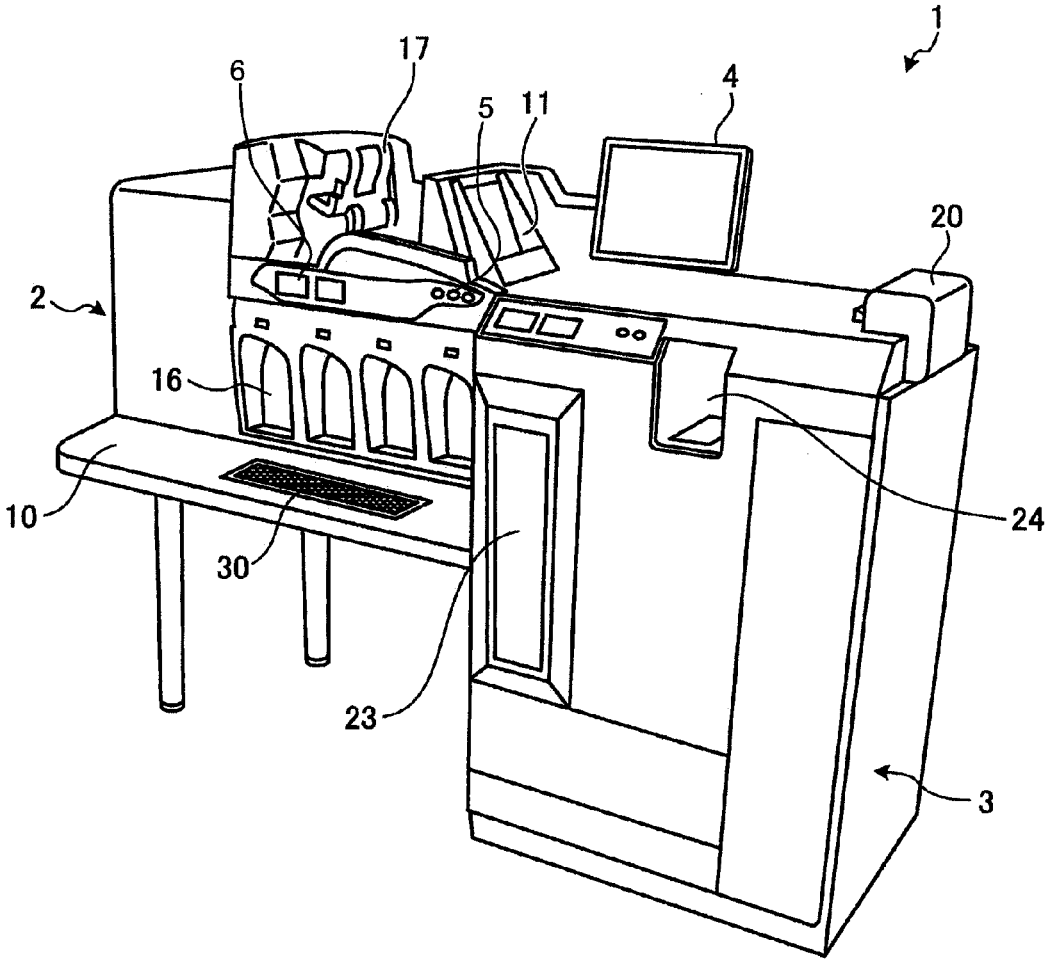
FIG. 1 is a perspective view of an outer appearance of a banknote processing device according to a first embodiment of the present invention.
Figure 2:
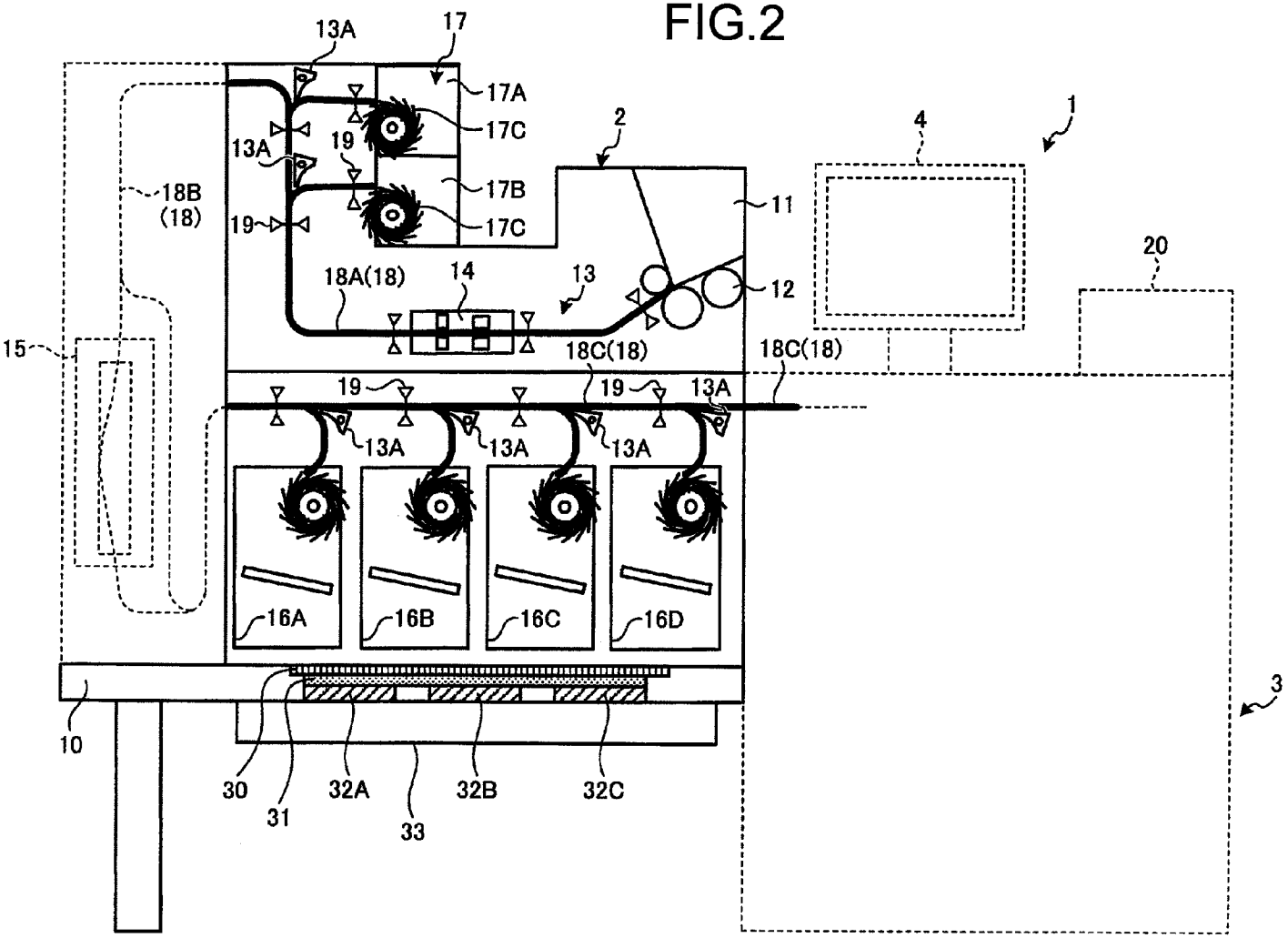
FIG. 2 is a schematic diagram of the banknote processing device according to the first embodiment.

FIG. 1 is a perspective view of an outer appearance of a banknote sorting and bundling apparatus 1 that includes a banknote processing device 2. FIG. 2 is a schematic diagram of an internal configuration of the banknote processing device 2. The banknote sorting and bundling apparatus 1 includes the banknote processing device 2, a banknote bundling device 3, and a display device 4. The banknote processing device 2 receives continuous deposits of banknotes, sorts and stacks the deposited banknotes by a banknote type, and counts the number of the deposited banknotes for each banknote type. The banknote bundling device 3 bundles into a bundle a predetermined number of banknotes of a specific denomination sorted by the banknote processing device 2. The display device 4 displays various types of information, for example, a count result, etc.

An overview of a configuration and a function of the banknote processing device 2 relating to banknote processing are explained first. The banknote processing device 2 includes: a hopper unit 11 for placing the banknotes that are to be deposited into the apparatus for a transaction; a feeding unit 12 that feeds the banknotes, one by one, that have been placed in the hopper unit 11; a banknote transporting unit 13, such as a transport belt, that transports the banknote fed by the feeding unit 12; a banknote recognition unit 14 that recognizes the type of the banknote being transported by the banknote transporting unit 13; and a banknote reversing unit 15 that reverses the banknote transported by the banknote transporting unit 13 based on front-face and back-face information, obtained from the banknote recognition unit 14, to arrange the banknote in a particular orientation.

The banknote processing device 2 further includes four stackers 16 for sorting and stacking the banknotes transported by the banknote transporting unit 13 according to the banknote type, and two first rejection units 17 for rejecting the banknotes that do not fit into the banknote type corresponding to either of the stackers 16 and the banknote bundling device 3. Each of the stackers 16 is an open stacking unit having an opening in a portion thereof for enabling removal of the banknotes stacked therein. A stacking wheel 16E (17C) that stacks the banknote that is being transported, one at a time, at a predetermined position in a banknote stacking space, is arranged in each of the stackers 16 and the first rejection units 17.

The four stackers 16 include a first stacker 16A, a second stacker 16B, a third stacker 16C, and a fourth stacker 16D. Each of these four stackers 16 corresponds to a pre-set banknote type. The term banknote type refers to, if Euro is taken as an example, the seven denominations of Euro, namely, 5 Euros, 10 Euros, 20 Euros, 50 Euros, 100 Euros, 200 Euros, and 500 Euros, as well as authenticity, fitness, face/back, etc., for each denomination. As shown in FIG. 1, an operation panel 5 for operating and setting the device, and a display 6 for displaying various information on the operations and the settings are provided on a lateral side of the banknote processing device 2. The openings of the stackers 16 are located on the same lateral side and below the operation panel 5 and the display 6. The banknote processing device 2 is installed on the table 10 so that the lateral side, on which the operation panel 5 and the display 6 are provided, faces toward a user. Thus, the user in front of the table 10 can operate the operation panel 5, look the information on the display 6 and remove banknotes stacked in the stackers 16 from the openings easily.

The banknote processing device 2 further includes a banknote transport path 18 that in turn includes a first transport path 18A that is connected to the hopper unit 11 and that passes above the stackers 16, a second transport path 18B that is connected to the first transport path 18A and that bends back in an arrangement direction of the stackers 16, and a third transport path 18C that is connected to the second transport path 18B and that connects the stackers 16 and the banknote bundling device 3.

The banknote recognition unit 14 is arranged on the first transport path 18A. The banknote reversing unit 15 is arranged on the second transport path 18B. The second transport path 18B is configured as a removable member that connects the first transport path 18A and the third transport path 18C of the banknote processing device 2. In some configuration the banknote reversing unit 15 may not be necessary, in that configuration a unit that includes only the second transport path 18B is used to connect the first transport path 18A and the third transport path 18C. Such a configuration has been shown in FIGS. 4A and 4B.

A detection sensor 19 that detects whether a banknote that is being transported approaches or passes by each branching point, merging point, and point of linkage between the devices is arranged at each of the above-mentioned points on the banknote transport path 18. A second rejection unit 20 is arranged at the far end of the third transport path 18C. Diverting units 13A that diverts the banknotes transported over the banknote transport path 18 to the stackers 16, the first rejection units 17, or the second rejection unit 20 are arranged at each of the branching points on the banknote transport path 18. The diverting unit 13A performs diverting of the banknote when the detection sensor 19 detects an approaching leading edge of the banknote. The diverting unit 13A is driven by a not shown solenoid.

An overview of the banknote reversing unit 15 and the banknote bundling device 3 is explained below. The banknote reversing unit 15 controls the transport direction of the banknote to a reversing route or a non-reversing route before reaching the banknote reversing unit 15 based on banknote front-face and back-face information obtained from the banknote recognition unit 14, so that the banknotes on the third transport path 18C are to be transported with a specific face, namely, the front face or the back face, facing up. The banknote bundling device 3 receives the banknotes of specific denomination from the third transport path 18C of the banknote processing device 2, and stacks the banknotes in a stacking unit inside the banknote bundling device 3. When a predetermined number of banknotes, for example, one hundred banknotes, have been stacked, the banknote bundling device 3 regards them as bundling object banknotes and proceeds to bundle them. The banknote bundling device 3 includes a bundle dispensing slot 23 that is located near the hopper unit 11. The bundled banknotes are dispensed from the bundle dispensing slot 23 so that an operator can collect them. The banknote bundling device 3 includes a loose-banknotes returning slot 24 from where loose banknotes are dispensed so that the operator can collect them at the end of a transaction. Even though detailed explanation of configurations and functions of the banknote reversing unit 15 and the banknote bundling device 3 have been omitted here, relevant technologies disclosed in Japanese Patent No. 4119664 and International Publication WO 2010/097954 can be used.

A dust collection function according to the present embodiment is explained below. The banknote processing device 2 is mounted on a table 10 that functions as the mounting table for the banknote processing device 2. As shown in FIG. 1, a dust collection vent 30 is provided on the table 10 in front of the openings of the stackers 16. As shown in FIG. 2, arranged downward from the dust collection vent 30 are a filter 31, three suction fans 32A to 32C, and a duct 33.

Figure 3A:
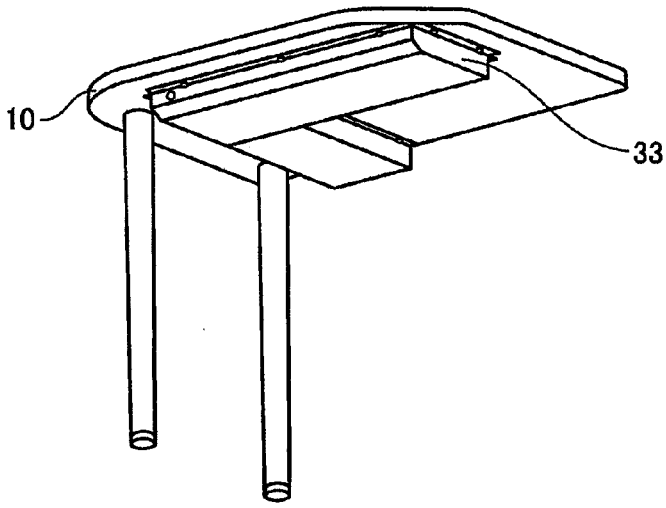
FIGS. 3A and 3B are schematic diagrams of an outer appearance and configuration of a mounting table for the banknote processing device according to the first embodiment.

FIG. 3A is a schematic diagram of the table 10 as viewed from below. The duct 33 is arranged on an underside surface of the table 10 so as to cover the suction fans 32. The duct 33 forms a substantially L-shaped exhaust passage. The duct 33, which surrounds the suction fans 32, extends in an arrangement direction of the stackers 16A to 16D before it bends, with an edge thereof connected to a back side of the table 10. An exhaust vent in the form of a through hole or a slit is formed at a junction of the edge of the duct 33 and the back side of the table 10. The exhaust vent, which serves as the junction between the back side of the table 10 and the duct 33, and the openings of the suction fans 32 are the sole openings of the exhaust passage formed by the duct 33. Consequently, the air sucked in by the suction fans 32 flows along an inner wall of the L-shaped duct 33 and is expelled through the exhaust vent of the back side of the table 10.

Figure 3B:
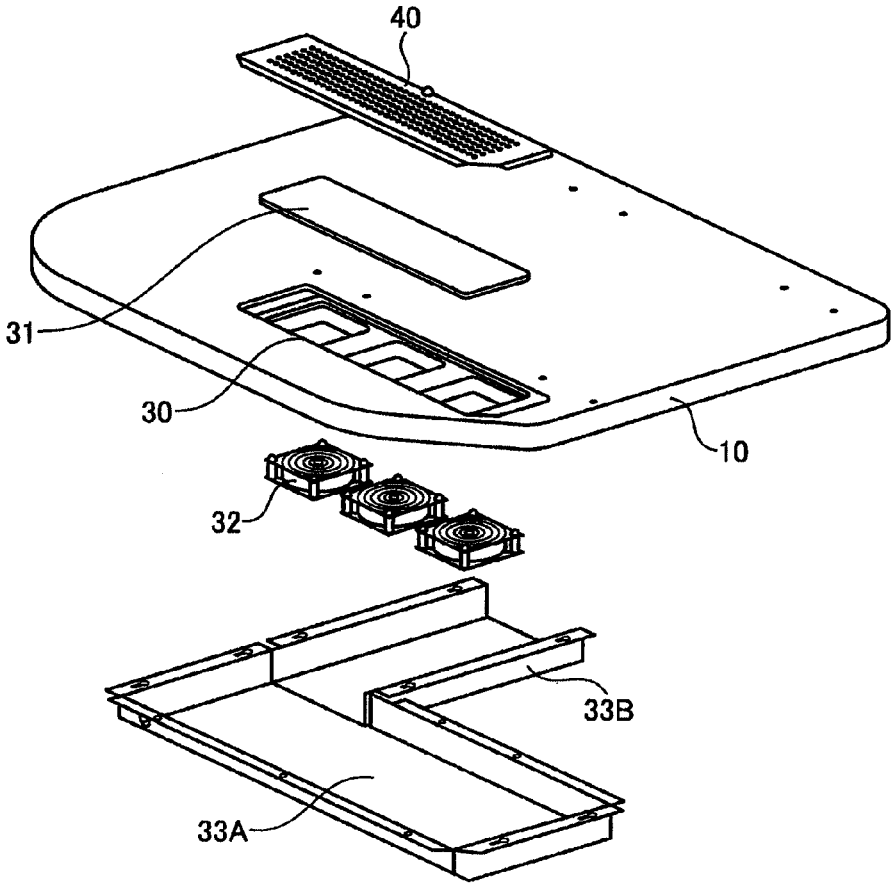

FIG. 3B is an exploded view of the table 10. The dust collection vent 30 functions as a suction vent for sucking in the dust dispersing from the openings of the stackers 16. The dust collection vent 30 includes a plate-like cover 40 having numerous through holes of circular or rectangular shape, such as a punching plate. The through holes are of a diameter of, for example, a few millimeters. That is, the through holes are small enough to keep stuff from falling into the dust collection vent 30. The plate-like cover 40 also functions as a filter cover that presses down on the filter 31 and holds the filter 31 firmly in place. The top surface of the cover 40 and the top surface of the table 10 are substantially aligned on a plane in the state where the cover 40 is properly mounted on the table 10. A plate-like member having oblong slits, or a resin or metal plate member having a mesh can be used as the cover 40. The cover 40 can have any configuration and be of any material as long as it facilitates dust to be sucked into the dust collection vent 30 while at the same time keep stuff from falling into the dust collection vent 30.

The filter 31 captures the dust from the dust-containing air sucked in through the dust collection vent 30. For example, urethane or sponge formed into thin plates can be used as the filter 31. The filter 31 is arranged so as to cover the suction fans 32. The filter 31 has a configuration such that the flow of the air sucked in through the dust collection vent 30 is not obstructed. Thus, the filter 31 captures only the dust from the dust-containing air sucked in by the suction fans 32 from the dust collection vent 30. The suction fans 32 and the duct 33 are prevented from becoming dirty because the air that flows towards them has already been filtered and rendered dust-free. Furthermore, a decrease in a suction performance of the suction fans 32 due to settling of the dust on the surface thereof, and a decrease in an exhaust performance due to blocking of the dust in the exhaust passage inside the duct 33 can be prevented by the filter 31.

The filter 31 is firmly held in place by the cover 40 inside the dust collection vent 30, thus ensuring that there is no gap between the filter 31 and the suction fans 32 through which the dust-containing air is sucked in before it passes through the filter 31. However, the filter 31 can be easily removed once the cover 40 is removed from the dust collection vent 30. Consequently, the filter 31 can be removed, the dust collected thereon can be cleaned, and can be re-installed. Apart from artificial fiber, various other materials such as paper and cloth can be used as the filter 31. The filter 31 can have any configuration and be made of any material as long as it performs a filtration function to remove the dust from the air sucked in from the dust collection vent 30 and lets the dust-free air to flow towards the suction fan 32. Noise caused by the rotation of the suction fans 32 and due to the flow of the air that is sucked in can be reduced if a sponge or urethane is used as the filter 31.

Each of the suction fans 32 generates an air flow when resin or metal blades thereof are caused to rotate by a motor, and sucks in the dust-containing air from the dust collection vent 30 via the filter 31. Most of the dust is trapped by the filter 31, and only dust-free air is allowed to flow into the duct 33 that is arranged after the suction fans 32.

The suction fans 32 operate when a switch that controls the motor to turn on or off is manually switched on. The rotation of the suction fans 32 is started by switching the motor on at a predetermined timing before an operation of the banknote processing device 2 starts, and stopped by switching off the motor once the use of the banknote processing device 2 ends.

The control of the suction fans 32 need not be limited to a manual operation. Automatic control can be employed by using a sensor to detect signals, etc. More specifically, the switch of the suction fans 32 can be controlled by a control unit of the banknote processing device 2 to be automatically switched on or off in conjunction with the operation of the banknote processing device 2. When banknote processing is begun by the banknote processing device 2, the banknotes are transported to and stacked in the stackers 16 causing the dust coming off the banknotes to disperse. The air flow caused by the transport and stacking of the banknotes settles down some time after the banknote processing is ended and the dispersion of the dust also stops. Consequently, control can be exerted such that the suction fans 32 are switched on simultaneously as the banknote processing is begun, and switched off after a lapse of a predetermined time after the banknote processing ends.

Alternatively, the control unit of the banknote processing device 2 can exert control such that the suction fans 32 are switched on and off according to the number of the banknotes being processed or a processing time. There can be instances where large amounts of banknotes are processed, requiring a long processing time and leading to generation of a large amount of dust. On the other hand, there can be instances where small amounts of banknotes are processed, and the banknote processing is performed for less than or equal to a predetermined number of banknotes or for less than or equal to a predetermined processing time, in which case there will be no significant dust generation. In the latter case, it is preferable from the point of view of energy saving that the suction fans 32 are kept switched off. Thus, setting can be done beforehand in the banknote processing device 2 so that the suction fans 32 are switched on only when the number of banknotes to be processed exceeds a predetermined value or when the processing time of the banknotes exceeds a predetermined value, and switched off after the banknote processing is ended.

The duct 33 is provided on the underside surface of the table 10 and it is used to expel the air flowing from the suction fans 32 from a predetermined position. It is desirable that the air be expelled from the back side of the banknote processing device 2 because the user occupies the area on a front side of the banknote processing device 2 where the openings of the stackers 16 are located. Therefore, the duct 33 constitutes the exhaust passage that covers the area of the suction fans 32 except the exhaust vent, which is provided on the back side of the table 10, and guides the air flowing from the suction fans 32 towards the exhaust vent.

The air from the duct 33 can also be expelled from a lateral side of the banknote processing device 2. Alternatively, a configuration is allowable in which the user can alter the exhaust passage to expel the air in a desired direction according to where the banknote processing device 2 and the table 10 are installed. More specifically, the duct 33 that covers the suction fans 32 can be formed by exhaust passages at a plurality of places extending towards the lateral sides and the back side of the table 10, with an openable and closable exhaust vent at the end of each exhaust passage. The user can select a desired exhaust vent from which the air is to be expelled according to where the table 10 is installed or usage conditions. An end of the exhaust passage formed by the duct 33 is connected to the exhaust vent arranged on the lateral sides or the back side of the table 10. Alternatively, a pipe, etc., can be used to extend the exhaust passage of the duct 33 from the lateral sides or the back side of the table 10 to be led out of the room where the banknote processing device 2 is installed.

Thus, according to the present embodiment, a space near the openings of the stackers 16 and a space inside the duct 33 are connected by the dust collection vent 30, the filter 31, and the suction fans 32. An air flow is generated by causing the suction fans 32 to rotate, and the dust dispersing from the stackers 16 is sucked in through the dust collection vent 30 provided near the openings of the stackers 16. Consequently, the dust generated in the course of banknote processing is prevented from dispersing from the openings of the stackers 16. The dust collection vent 30 is located in front of the openings of the stackers 16 where the dust is most likely to settle. Consequently, dust can be effectively prevented from settling on the table 10.

Furthermore, because the dust is blocked by the filter 31, a decrease in the performances of the suction fans 32 and the duct 33 due to the dust can be prevented. By holding the filter 31 firmly in place, the cover 40 ensures that the dust is filtered without fail. Moreover, the cover 40 and the filter 31 can be easily removed from the table 10 for cleaning etc. Thus, the filter 31 can be periodically cleaned or replaced to prevent a decrease in the dust collection performance due to clogging of the filter 31. Furthermore, because the flow of the air sucked in through the dust collection vent 30 is controlled by the duct 33 and the air is expelled from the back side, etc., of the banknote processing device 2, away from the user, even if the air contains minute dust particles that have passed through the filter 31, inhalation of the dust-containing air by the user can be prevented.

Second Embodiment

Figure 4B:
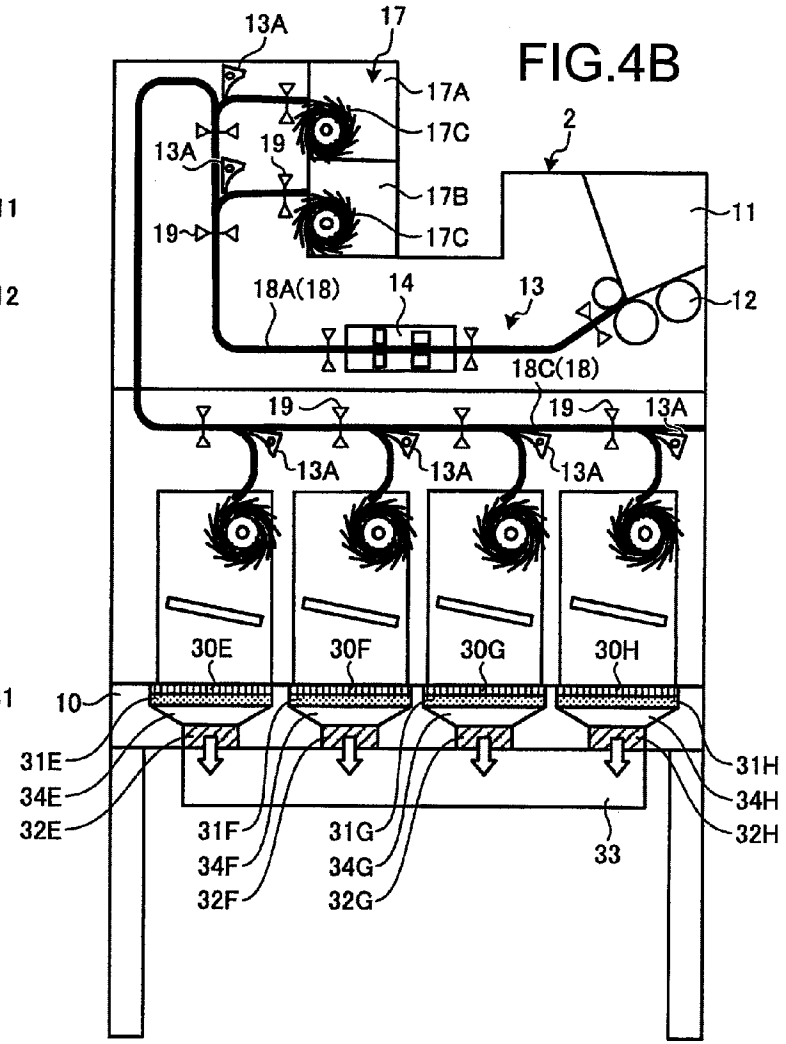
FIGS. 4A and 4B are schematic drawings showing a front view of a banknote processing device according to another embodiment of the present invention.
Figure 4A:
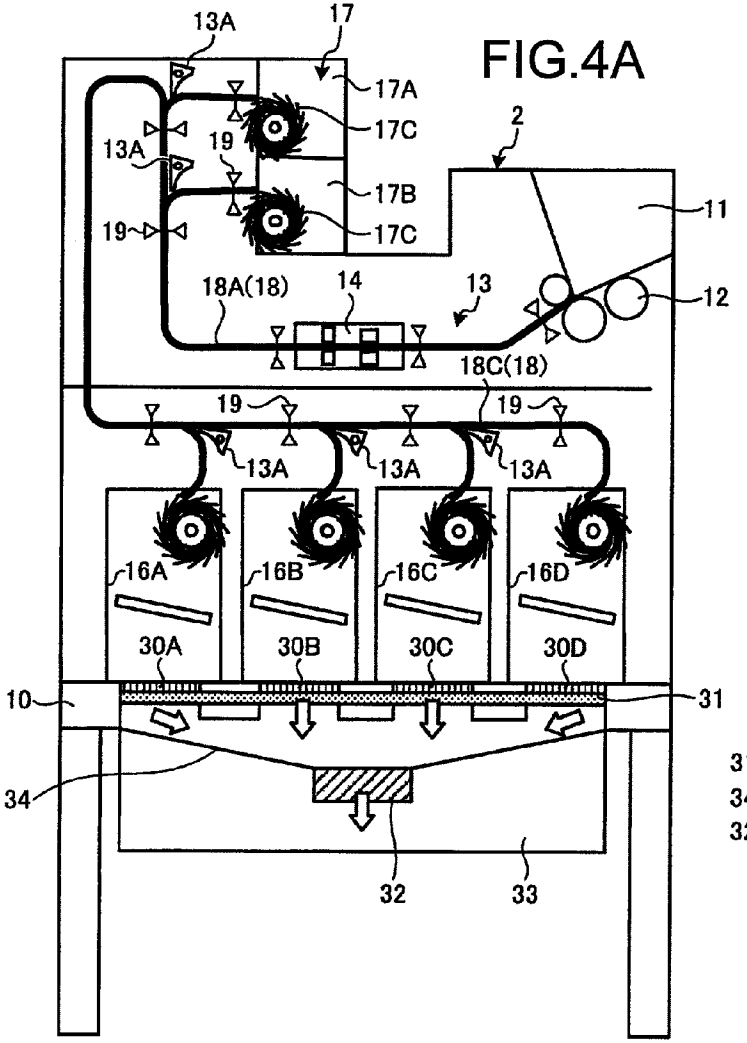

FIGS. 4A and 4B are schematic diagrams of the banknote processing device 2 according to a second embodiment of the present invention. Parts that are identical to those in the banknote processing device 2 according to the first embodiment have been assigned the same reference symbols, and detailed explanation of the configuration and function thereof is omitted.

The banknote processing device 2 shown in FIGS. 4A and 4B differs from the banknote processing device 2 according to the first embodiment in that dust collection vents 30A to 30H are provided inside the stackers 16 instead of on the table 10.

Figure 5A:
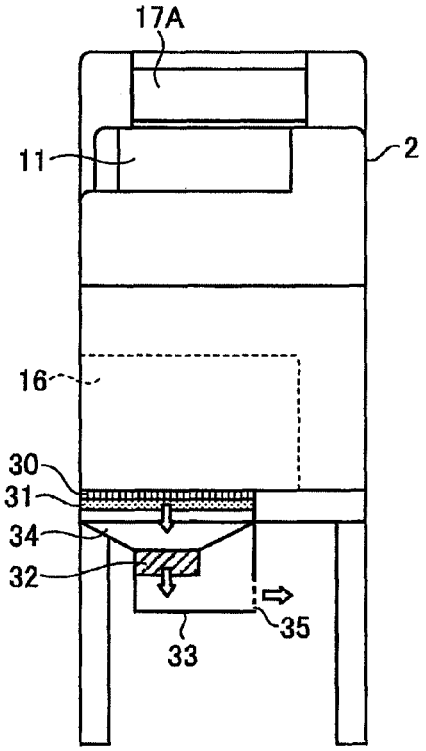
FIGS. 5A and 5B are schematic drawings showing a side view of a banknote processing device according to yet another embodiment of the present invention.

The banknote processing device 2 shown in FIG. 1 is placed on the table 10 that juts out in front of the openings of the stackers 16. The table 10 has a larger surface area than a bottom surface area of the banknote processing device 2. However, the table 10 that has substantially the same surface area as the bottom surface area of the banknote processing device 2 can also be used for placing the banknote processing device 2. In the banknote processing device 2 according to the second embodiment, the dust collection vent 30 is provided on a bottom face of each of the stackers 16, as shown in FIG. 5A. Consequently, a dust collection function that is similar to that of the first embodiment is realized by the dust collection vent 30, even under circumstances that do not allow use of a large-sized table 10.

Figure 5B:
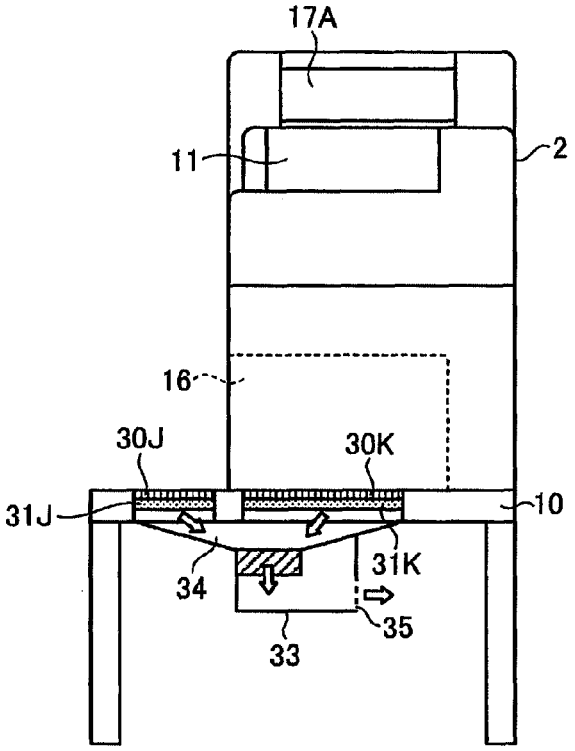

The air sucked in by the dust collection vent 30 provided inside each of the stackers 16 is led to the duct 33 via the filter 31 and the suction fan 32, and is expelled through an exhaust vent 35 provided on the back side of the banknote processing device 2, as shown in FIGS. 5A and 5B.

As shown in FIG. 4A, a single suction fan 32 can be used to suck in the air from the individual dust collection vent 30 provided for each of the stackers 16 via a single filter 31. Alternatively, as shown in FIG. 4B, separate suction fans 32E to 32H can be used to suck in the air from the dust collection vents 30E to 30H. That is, one suction fan can be arranged for each of the stackers 16, via respective filters 31E to 31H.

The filter 31 shown in FIG. 4A can be drawn out from the front side of the banknote processing device 2. The advantage of providing a single filter 31 for the four dust collection vents 30A to 30D is that cleaning or replacement of the filter 31 can be performed quickly. A large-sized suction fan 32 is used compared to that of the first embodiment in view of the fact that a single suction fan 32 is used for sucking in the air from the four dust collection vents 30A to 30D. Furthermore, a suction passage 34 from the dust collection vents 30A to 30D to the suction fan 32 is made conical or prismoidal (inverted truncated pyramid shape) to increase the suction efficiency. Although, a case where a single suction fan 32 is used is given as an example, a plurality of the suction fans 32 can also be provided below the single filter 31, as in the first embodiment or as shown in FIG. 4B.

Similar to the filter 31 shown in FIG. 4A, the filters 31E to 31H shown in FIG. 4B can also be drawn out from the front side. The advantage of providing separate filters 31E to 31H, respectively, for the four dust collection vents 30E to 30H is that each of the filters 31E to 31H can be individually cleaned or replaced. For example, if an amount of the banknotes assigned to the stacker 16A circulated in the market is larger, a larger amount of banknotes will be transported to and stacked in the stacker 16A as compared to the other stackers 16B to 16D. Consequently, the filter 31E will get dirtier in a shorter duration compared to the other filters 31F to 31H. In such a case, only the dirtier filter 31E can be cleaned or replaced. Furthermore, there is an advantage that the dust can be sucked in with greater power by providing separate suction fans 32E to 32H close to the dust collection vents 30E to 30H, respectively. If a surface area of the suction fan 32 is smaller than a surface area of the dust collection vents 30E to 30H, the suction efficiency of suction passages 34E to 34H can be increased by making the suction passages 34E to 34H bowl-shaped, as shown in FIG. 4A. However, the present embodiment is not to be thus limited; a single suction fan 32 can be used, as shown in FIG. 4A. The configuration can be also changed so that the filter 31 can be removed from the dust collection vent 30 from above after removal of the cover 40 as in the first embodiment.

In the present embodiment, the banknote processing device 2 and the table 10 that has legs have been explained. However, the present invention is not to be thus limited. The table 10 can be legless. Alternatively, the table 10 and the banknote processing device 2 can be a single integrated unit, and the dust collection vent 30, the filter 31, the suction fan 32, and the duct 33 can be incorporated into the banknote processing device 2. Furthermore, the dust collection vent 30 can be provided on a side surface or a top surface of the stacker 16 instead of on the bottom surface. For example, if the stacker 16 has a stage, which is a plate without any opening for stacking the banknotes, a good dust collection function can be achieved by providing the dust collection vent 30 on the side surface or the top face of inner walls of the stacker 16. An appropriate position of the dust collection vent 30 can be decided according to a configuration of the stacker 16. The layout or the configuration of the banknote processing device 2 need not be limited to those explained in the present embodiment as long as the dust collection vent 30 is provided in a portion of the stacker 16, the dust generated inside the stacker 16 during the banknote processing is sucked in by a suction force generated by the suction fan 32, the dust from the air that is sucked in is captured by the filter 31, and a dust-free air is expelled from a predetermined position by the duct 33.

Third Embodiment

FIG. 5B is a schematic diagram of the banknote processing device 2 according to a third embodiment of the present invention. Parts that are identical to those in the banknote processing device 2 according to the first and second embodiments have been assigned the same reference symbols, and detailed explanation of the configuration, operation, and function thereof is omitted. A front view of the banknote processing device 2 is identical to those shown in FIG. 2 and FIGS. 4A and 4B; therefore, only a side view of the banknote processing device 2 is shown in FIG. 5B.

The banknote processing device 2 shown in FIG. 5B differs from the first and second embodiments in that a dust collection vent 30J is provided in front of the stacker 16 on the table 10 that juts out from the bottom surface of the banknote processing device 2, as explained with reference to FIGS. 1 and 2, and furthermore, a dust collection vent 30K is provided inside the stacker 16, as explained with reference to FIGS. 4A, 4B, and 5A. The configuration and operation of the other parts are similar to those in the first and second embodiments and hence detailed explanation thereof is omitted.

In this manner, the structures and functions of the dust collection vent 30, the filter 31, the suction fan 32, and the duct 33 explained in the first and second embodiments can be combined in various ways.

Meanwhile, the table 10 and the banknote processing device 2 can be configured as separate units or can be configured as a single integrated unit. As a specific aspect, for example, the table 10 can be provided as an extension from a bottom edge of the opening of the stacker 16 towards the front, thus forming an integral unit with the banknote processing device 2, and the dust collection vent 30 can be provided on the table 10.

As shown in FIG. 5B, by providing the dust collection vent 30K inside the stacker 16 near the opening thereof, and the dust collection vent 30J on the table 10 outside the stacker 16 near the opening thereof, the dust that is generated inside the stacker 16 is collected by the dust collection vent 30K that is inside the stacker 16 and the dust that comes out of the stacker 16 is collected by the dust collection vent 30J that is outside the stacker 16. Furthermore, the air sucked in by the suction fan 32 can be expelled as it is without providing the duct 33, if there is no need to expel the air sucked in by the suction fan 32 from the side face, rear face of the table 10, or to lead the air outside the room. If the filter 31 has a superior performance and can clean the air thoroughly by removing the dust, the duct 33 need not be provided.

Thus, in the banknote processing device and the mounting table therefor according to the present application, the paper dust and dirt dispersing from the opening of the stacker is sucked in by the dust collection vent provided inside or in front of the opening of the stacker, filtered by the filter, and the dust-free clean air is expelled from the back side of the device.

In the stacker 16 where the dust is generated, the dust can be efficiently collected if the dust collection is performed in an enclosed space with the opening being the only open portion. Furthermore, if the dust can be collected in front of the opening on the table 10 where the dust is most likely to settle, the table 10 can be efficiently prevented from becoming dirty.

The banknote processing device and the mounting table therefor according to the present application are useful for efficient collection of paper dust and dirt dispersing from the stacker that is open.

According to an aspect of the present invention, a dust collection vent is arranged in front of an opening of a stacking unit on a mounting table on which a banknote processing device that includes the stacking unit is installed. Consequently, when the banknote processing device is installed on the mounting table, dust that is most likely to settle in front of the opening is efficiently collected.

According to another aspect of the present invention, a suction fan and a filter are provided. The suction fan sucks the dust into the dust collection vent and the filter is arranged between the dust collection vent and the suction fan to capture the dust from air sucked in through the dust collection vent. Consequently, only clean air reaches the suction fan.

According to still another aspect of the present invention, a duct is provided that forms an exhaust passage around the suction fan, includes an exhaust vent in a portion of the exhaust passage, and expels the air that is sucked by the suction fan through the exhaust vent. Consequently, a dust-free air is expelled through the exhaust vent in a desired direction.

According to still another aspect of the present invention, when in use, the filter is firmly held in place to enable fail-proof filtration of the dust, and when not in use the filter can be easily removed for cleaning. Consequently, a decrease in a dust collection performance due to clogging of the filter is easily prevented.

According to still another aspect of the present invention, the dust collection vent is provided inside the stacking unit of the banknote processing device. Consequently, the dust is efficiently collected inside the stacking unit itself where the dust is generated.

According to still another aspect of the present invention, a separate filter is provided for each stacking unit. Consequently, the filter of the stacking unit that is used frequently and that gets dirty alone can be cleaned or replaced.

According to still another aspect of the present invention, a separate suction fan is provided for each stacking unit. Consequently, the dust generated inside the stacking unit is collected without fail by the suction fan of the stacking unit.

According to still another aspect of the present invention, the dust collection vent is provided on a bottom face of the stacking unit. Consequently, the dust is efficiently collected in the bottom face of the stacking unit where the dust is most likely to settle.

According to still another aspect of the present invention, one dust collection vent is provided inside the stacking unit and the other on the table that is in front of the stacking unit. Consequently, the dust is efficiently collected inside the stacking unit itself where the dust is generated and in front of the opening of the stacking unit where the dust is most likely to settle.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A mounting table, on which a banknote processing device is mounted, the banknote processing device including a plurality of stacking units each having an opening, the mounting table comprising:

a dust collection vent that is formed in the mounting table in front of the banknote processing device mounted on the mounting table and that collects dust coming out of openings of the plurality of stacking it units.

2. The mounting table according to claim 1, further comprising:

a suction fan that sucks the dust into the dust collection vent; and a filter that is arranged between the dust collection vent and the suction fan, and that captures the dust from air that is sucked in through the dust collection vent.

3. The mounting table according to claim 2, further comprising a duct that forms an exhaust passage around the suction fan, wherein the duct includes an exhaust vent in a portion of the exhaust passage, and expels the air that is sucked by the suction fan through the exhaust vent.

4. The mounting table according to claim 2, further comprising a cover that is detachable to the dust collection vent, and that is in the form of a plate having a plurality of through holes, wherein the cover holds the filter firmly in place inside the dust collection vent when the cover is fitted onto the dust collection vent and allows the filter to be removed from inside the dust collection vent when the cover is removed from the dust collection vent.

5. A banknote processing device that counts banknotes, comprising:

a plurality of stacking units each including:

an opening to enable removal of the banknotes stacked inside the stacking unit; and a dust collection vent for collecting dust inside the stacking unit, wherein the dust collection vent is provided in a bottom surface that is inside of each of the plurality of stacking units.

6. The banknote processing device according to claim 5, further comprising:

a suction fan that sucks the dust into the dust collection vent; and a filter that is arranged between the dust collection vent and the suction fan so as to be removable from the banknote processing device, and that captures the dust from air sucked in through the dust collection vent.

7. The banknote processing device according to claim 6, further comprising a duct that forms an exhaust passage around the suction fan, wherein the duct includes an exhaust vent in a portion of the exhaust passage, and expels the air that is sucked by the suction fan through the exhaust vent.

8. The banknote processing device according to claim 6, wherein a separate filter is provided for each of the plurality of stacking units.

9. The banknote processing device according to claim 6, wherein a separate suction fan is provided for each of the plurality of stacking units.

10. The banknote processing device according to claim 6, further comprising a table that is arranged in front of openings of the plurality of stacking units, wherein the table includes a second dust collection vent that communicates with the suction fan.

11. The banknote processing device according to claim 10, further comprising a second filter that is arranged between the second dust collection vent and the suction fan so as to be removable from the table, and that captures the dust from the air sucked in through the second dust collection vent.

12. A banknote processing device that counts banknotes, comprising:

a plurality of stacking units each having an opening for enabling removal of the banknotes stacked therein; and a table that extends in front of openings of the plurality of stacking units, wherein the table includes a dust collection vent that is formed in the table in front of the openings of the stacking units and that collects dust coming out of the openings of the plurality of stacking units.

13. The banknote processing device according to claim 12, further comprising:

a suction fan that sucks the dust into the dust collection vent; and a filter that is arranged between the dust collection vent and the suction fan so as to be removable from the banknote processing device, and that captures the dust from air sucked in through the dust collection vent.

14. The banknote processing device according to claim 13, further comprising a duct that forms an exhaust passage around the suction fan, wherein the duct includes an exhaust vent in a portion of the exhaust passage, and expels the air that is sucked by the suction fan through the exhaust vent.

15. The banknote processing device according to claim 5, further comprising a table for mounting the banknote processing device, wherein the table has an opening that communicates with the dust collection vent, and air inside the plurality of stacking units can be expelled through the dust collection vent and the opening.

16. The banknote processing device according to claim 5, further comprising a table that is arranged in front of openings of the plurality of stacking units, wherein the table includes a second dust collection vent for collecting the dust.

17. A banknote processing device that counts banknotes, comprising:

a plurality of stacking units each having only one opening that is formed in one surface of each of the plurality of stacking units for enabling removal of the banknotes stacked inside each of the plurality of stacking units; and a dust collection vent that is formed inside of each of the plurality of stacking units to collect dust inside each of the plurality of stacking units, the dust collection vent being formed in a surface other than the one surface that includes the only one opening.

18. A mounting table on which a banknote processing device that includes a stacking unit with an opening is mounted, the mounting table comprising:

a dust collection vent that is formed in the mounting table in front of the opening of the stacking unit of the banknote processing device being mounted on the mounting table and that collects dust coming out of the opening of the stacking unit.

19. A banknote processing device that counts banknotes, comprising:

a stacking unit that has an opening for enabling removal of the banknote stacked therein; and a table that extends in front of the opening of the stacking unit, wherein the banknote processing device is mounted on the table, and the table includes a dust collection vent that is formed in the table in front of the opening of the stacking unit and that collects dust coming out of the opening of the stacking unit.

* * * * *